US007435123B2

(12) United States Patent
Franks, Jr.

(10) Patent No.: US 7,435,123 B2
(45) Date of Patent: Oct. 14, 2008

(54) ELECTRICAL CONNECTOR WITH AN ENVIRONMENTAL SEAL

(75) Inventor: George J. Franks, Jr., Inverness, IL (US)

(73) Assignee: Senior Industries, Inc., Wood Dale, IL (US)

( * ) Notice: Subject to any disclaimer, the term of this patent is extended or adjusted under 35 U.S.C. 154(b) by 0 days.

(21) Appl. No.: 11/668,964

(22) Filed: Jan. 30, 2007

(65) Prior Publication Data

US 2007/0123077 A1 May 31, 2007

Related U.S. Application Data

(63) Continuation of application No. 10/785,917, filed on Feb. 24, 2004, now Pat. No. 7,384,291.

(51) Int. Cl.
*H01R 13/52* (2006.01)

(52) U.S. Cl. ..... 439/271; 439/277

(58) Field of Classification Search ..... 439/271, 439/277, 559

See application file for complete search history.

(56) References Cited

U.S. PATENT DOCUMENTS 5,857,865 A * 1/1999 Shimirak et al. ..... 439/277
6,113,410 A * 9/2000 Heit et al. ..... 439/321

* cited by examiner

*Primary Examiner*—Javaid Nasri
(74) *Attorney, Agent, or Firm*—Bell, Boyd & Lloyd LLP

(57) ABSTRACT

An electrical connection is provided for connecting electrically transmitting cables and/or wires to one another or any other component in a manner that provides an environmentally sealed connection. The electrical connection includes an electrical connector for connecting electrical cables or wires that includes seals which are disposed in grooves in the threaded portions of the electrical connector. The electrical connector may also include a second set of grooves separated from the first set of grooves, in order to cause moisture and other debris to migrate away from the seals. When the end connectors of electrical cables or wires are connected to the electrical connector, the interior threads of end connectors cover and deform the surface of the seals to create an enhanced seal between the connector and the end connectors. Thus, the electrical connector effectively seals the interface between the connector and the end connectors of electrical cables or wires, such that moisture and other debris are prevented and/or substantially deterred from migrating into the interior of the cable or wire.

23 Claims, 4 Drawing Sheets

ELECTRICAL CONNECTOR WITH AN ENVIRONMENTAL SEAL

PRIORITY CLAIM

This application claims priority to and the benefit as a continuation application of U.S. patent application entitled "Electrical Connection," Ser. No. 10/785,917, filed Feb. 24, 2004.

BACKGROUND

The present invention is directed to an electrical connection and, more particularly, to a connection for connecting electrically transmitting cables and/or wires to one another or other components in a manner that provides an environmentally sealed connection.

SUMMARY

Electrical signal-type distribution cables or wires are used to deliver data transmission services, such as those for telecommunications, cable television and internet, to commercial and residential buildings. These distribution systems are located outside of the buildings and do not directly enter the structures. Rather, the buildings include an internally wired system to distribute the electrical signal or transmission throughout the structure. Thus, there generally is an interconnection between the distribution system bringing the service to the buildings and the internal wiring which transmits the service into and throughout the buildings. Often, this interconnection is outside of the building and, therefore, is exposed to the elements, such as rain, snow, and other forms of moisture and foreign debris.

Likewise, electrical signal-type cables or wires are used to distribute services throughout the interior of commercial and residential buildings. These internal wiring systems often involve interconnections between lengths of cable and other components using electrical connectors, such as splices or splitters, as well as other similar hardware. In some cases, the interconnections may be exposed to high levels of moisture, such as high levels of humidity in buildings located in humid climates or in a basement of a building, and/or foreign debris, such as high levels of dust which maybe present in a workshop or similar location. Therefore, under certain circumstances the internal wiring of a building also may be exposed to conditions that would benefit from an environmentally sealed connection.

When the interconnection between the ends of two cables, such as coaxial cable from a service distribution system and a coaxial cable running through the interior of a structure, is located on the outside of the structure or in certain areas within a structure, moisture or other foreign debris, such as dirt or dust, can migrate into the connection and the interior of the cables through the cable connection at an electrical connector, such as an F-connector. The migration of moisture and other debris into the connection and/or the interior of the cables is found to interfere with the integrity of the signal. This interference results from a deterioration of the cable and connector component and the electrical contact between such components.

Prior art electrical connectors have attempted to prevent the migration of moisture and other debris into the connection and the interior of the cables by mounting an o-ring at the ends of the threads of the connector (i.e., against the hexagonal flange of the connector), such that the end connector was intended to form a seal by pressing the o-ring against the flange when it was tightened onto the electrical connector. However, due to manufacturing variations of both the electrical connectors and the end connectors of the electrical cables and wires, the end connector often "bottoms out" before coming into contact with the o-ring or before pressing the o-ring sufficiently against the flange to form an effective seal, Thus, the end connector could not be tightened onto the electrical connector a distance sufficient to use the o-ring to form an environmental seal. In such cases, therefore, the connection between the end connectors of the cables or wires and the electrical connectors was not environmentally sealed and moisture and other debris was free to migrate into the interior of the connection and of the cables or wires, and the interference discussed above was not prevented.

Additional features and advantages are described herein, and will be apparent from, the following Detailed Description and the figures.

DETAILED DESCRIPTION

Figure 1:
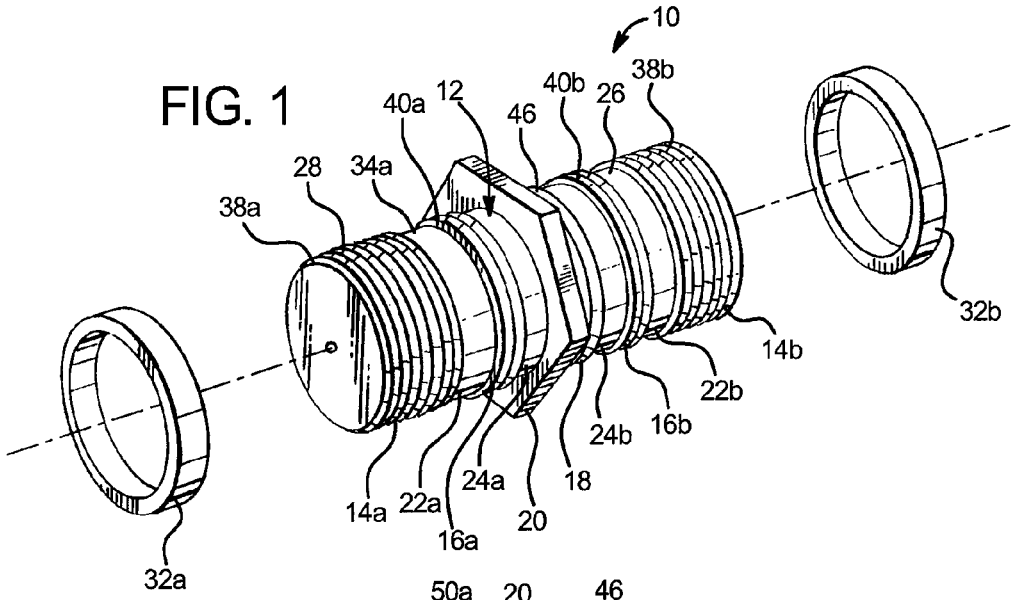
FIG. 1 is an exploded perspective view of an electrical connector according to any new design.

Referring to FIGS. 1-4, there is illustrated an electrical connector 10 having a body 12. The body 12 includes outer threaded portions 14*a*, 14*b* and inner threaded portions 16*a*, 16*b*, which are separated by outer grooves 22*a*, 22*b*. Seal members, such as o-rings 32*a*, 32*b*, are disposed in the outer grooves 22*a*, 22*b*. The body 12 also includes inner grooves 24*a*, 24*b*. When cable or end connectors 42*a*, 42*b* of electrical cables 48*a*, 48*b* are connected to the electrical connector 10, interior threads 44*a*, 44*b* of end connectors 42*a*, 42*b* cover and deform the surfaces of the seal members and create a seal between the electrical connector 10 and the end connectors 42*a*, 42*b*. The outer grooves 22*a*, 22*b* and the seal members are sized and axially located such that the electrical connector 10 provides an effective seal between the electrical connector 10 and the end connectors 42*a*, 42*b* of electrical cables or wires, regardless of the length of the end connectors 42*a*, 42*b*, such that moisture and other debris are substantially prevented from migrating into the interior of the cable. Thus, the electrical connector 10 provides a universal-type seal arrangement to accommodate varying sized end connectors of cables and wires.

The body 12 includes a hexagonal flange 20 separating a first cylindrical portion 34*a* and a second cylindrical portion 34*b*. The two cylindrical portions 34*a*, 34*b* surround the interior structure of the electrical connector 10 used to make the necessary electrical contact with the cable or wire. The first cylindrical portion 34*a* includes one of the outer threaded portions 14*a* and inner threaded portions 16*a*. The second cylindrical portion 34*b* includes the other outer threaded portion 14*b* and inner threaded portion 16*b* and a threaded mounting portion 18. The respective diameters of the cylindrical portions 34*a*, 34*b*, as well as the outer threaded portions 14*a*, 14*b*, the inner threaded portions 16*a*, 16*b*, and the threaded mounting portion 18 are sized to allow the connection of electrical cable or wire connectors to each of the cylindrical portions 34*a*, 34*b* of the electrical connector 10 by threading the connector ends onto the cylindrical portions 34*a*, 34*b*.

The body 12 is constructed of a conductive material, preferably brass with tin plating. The internal structure of the electrical connector is that of any conventional electrical connector known in the art and may include a conductive center surrounded by an insulating jacket.

The body 12 and hexagonal flange 20 may be sized to be coordinated with the size of the wire or cable which are to be attached to the electrical connector 10. For example, if a conventionally sized coaxial cable, such as that used to distribute cable television or cable internet signals, is to be attached to the connector 10, the body 12 may have an overall length of approximately 1.025±0.010 inches and the cylindrical portions 34*a*, 34*b* may have an outer thread diameter of approximately 0.365±0.010 inches, while the hexagonal flange 20 may have a thickness of approximately 0.145±0.010 inches, a diameter of approximately 0.432±0.010 inches between opposing flats of the hexagon, and a diameter of approximately 0.490±0.010 inches between opposing corners of the hexagon. The outer threaded portions 14*a*, 14*b* and the inner threaded portions 16*a*, 16*b* may be of 3/8-32 UNEF-2A threading, although alternative threading may be used in conjunction with other sizes of electrical cable and corresponding end connectors. Further, the threaded mounting portion 18 may include the same threads as the outer and inner thread portions for consistency and ease of manufacturing.

The outer threaded portions 14*a*, 14*b* include threads 38*a*, 38*b* for mating with the interior threads 44*a*, 44*b* of the end connectors 42*a*, 42*b* of electrical cables or wires. Likewise, the inner threaded portions 16*a*, 16*b* include threads 40*a*, 40*b* for mating with the interior threads 44*a*, 44*b* of the end connectors 42*a*, 42*b*. The threads 38*a*, 38*b* of the outer threaded portions 14*a*, 14*b* and the threads 40*a*, 40*b* of the inner threaded portions 16*a*, 16*b* are circumferentially and axially aligned, so as to be continuous, such that interior threads 44*a*, 44*b* of end connectors 42*a*, 42*b* of electrical cables 48*a*, 48*b* may be fully attached to the outer threaded portions 14*a*, 14*b* and the inner threaded portions 16*a*, 16*b* without damaging the threads. That is, if the threads 38*a*, 38*b* of the outer threaded portions 14*a*, 14*b* and the threads 40*a*, 40*b* of the inner threaded portions 16*a*, 16*b* are offset around the circumference of the cylindrical portions 34*a*, 34*b*, the end connectors 42*a*, 42*b* of the electrical cables 48*a*, 48*b* can be prevented from or be difficult to fully threading into the electrical connector 10, because the interior threads 44*a*, 44*b* cannot thread onto the offset threads of the inner portions 16*a*, 16*b* after threading onto the outer threaded portions 14*a*, 14*b*. In any event, the threads of the end connector and/or the electrical connector may become damaged when the threads of the outer and inner threaded portions 14*a*, 14*b*, 16*a*, and 16*b* are offset, affecting the seal and securement of the cables and/or wire to the connector.

The body 12 preferably also includes the threaded mounting portion 18 that cooperates with a nut or other similar component to securely attach the electrical connector 10 to a supporting structure. For example, if it is desirable to ground the splice between two wires or cables, the electrical connector 10 may be connected to a grounding structure, such as a grounding connector, by extending the cylindrical portion 34*b* of the electrical connector 10 through an aperture in the grounding structure, with the hexagonal flange 20 on one side of the aperture and threading a nut, or other similar component, onto the threaded mounting portion 18 such that the nut is flush against the opposite side of the aperture. The threads 46 of the threaded mounting portion 18 are preferably circumferentially and axially aligned with the threads 38*b* of the outer threaded portion 14*b* and the threads 40*b* of the inner threaded portion 16*b*, to enable the nut to be threaded easily onto the threads 46 of the inner threaded portion 18 without damaging any of the threading on the electrical connector. However, the threaded mounting portion 18 may alternatively be omitted if such an ability to connect to a supporting or grounding structure is not necessary.

As illustrated in FIGS. 1-4, the first cylindrical portion 34*a* defines an outer annular groove 22*a* and an inner annular groove 24*a*. Likewise, the second cylindrical portion 34*b* defines an outer annular groove 22*b* and an inner annular groove 24*b*. The outer annular grooves 22*a*, 22*b* and inner grooves 24*a*, 24*b* preferable have a diameter which is less than that of the threaded portions 14*a*, 14*b*, 16*a*, 16*b*, and 18. For example, the outer grooves 22*a*, 22*b* and inner grooves 24*a*, 24*b* may have a diameter of approximately 0.30±0.010 inches. The outer grooves 22*a*, 22*b* and the inner grooves 24*a*, 24*b* may also be defined by unthreaded portions of the cylindrical portions 34*a*, 34*b* of the body 12.

The outer grooves 22*a*, 22*b* and the inner grooves 24*a*, 24*b* may have a variety of axial lengths. The outer grooves 22*a*, 22*b* should correspond with the width of the seal member. For example, where the electrical connector 10 is to be used with conventionally sized coaxial cable end connectors, the axial length of the outer grooves 22*a*, 22*b* may be approximately 0.075±0.010 inches. The inner grooves 24*a*, 24*b* should have an axial length that effectively deflects moisture and other foreign debris away from the sealed connection. For example, the grooves 24*a*, 24*b* may have the same axial length as the grooves 22*a*, 22*b*, but also may have differing axial lengths.

The outer groove 22*a* is located between the outer threaded portion 14*a* and the inner threaded portion 16*a* on a first side 28 of the connector 10. The outer groove 22*b* is located between the outer threaded portion 14*b* and the inner threaded portion 16*b* on a second side 26 of the connector 10.

Preferably, the outer grooves 22*a*, 22*b* are axially located such that the end connectors 42*a*, 42*b* of the electrical cables 48*a*, 48*b* extend beyond the outer grooves 22*a*, 22*b* when the end connectors 42*a*, 42*b* are threaded onto the electrical connector 10. The outer grooves 22*a*, 22*b* are axially located such that when the variation in the depth of the end connectors 42*a*, 42*b* of the electrical cables 48*a*, 48*b* is taken into account, the location of the outer grooves 22*a*, 22*b* is such that a variety of different end connectors extend partially over, or over and beyond, the outer grooves 22*a*, 22*b*. For example, if the electrical connector is to be used with conventionally sized coaxial cable end connectors the outer threaded portions 14*a*, 14*b* may have an axial length of approximately 0.165±0.010 inches and the outer grooves 22*a*, 22*b* may have an axial length of approximately 0.075±0.010 inches.

Figure 2:
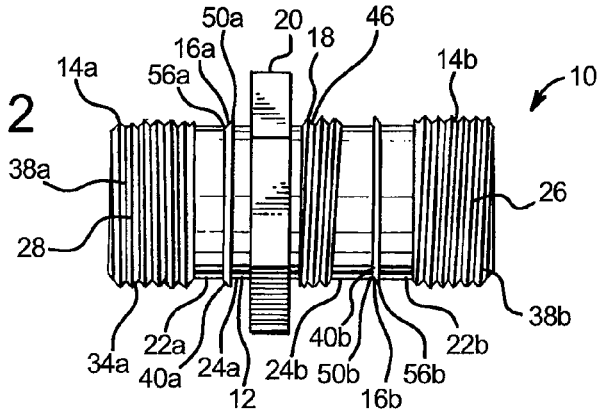
FIG. 2 is a elevational view of the electrical connector of FIG. 1 without the o-rings.
Figure 3:
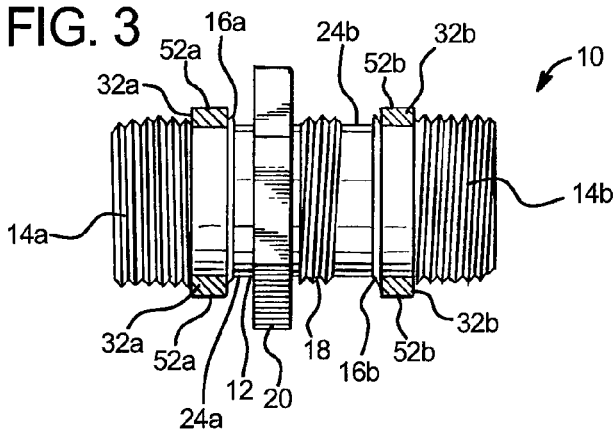
FIG. 3 is an elevational view of the electrical connector of FIG. 1, including a cross-sectional view of the o-rings mounted on the electrical connector.

The inner grooves 24*a*, 24*b* preferably are located adjacent the inner threaded portions 16*a*, 16*b*. The inner groove 24*a* is located between inner threaded portion 16*a* and the hexagonal flange 20 on the side 28 of the connector 10. The inner groove 24*b* is located between inner threaded portion 16*b* and the threaded mounting portion 18, if the threaded mounting portion 18 is present on the electrical connector 10 (such as on the side 26 of the electrical connector 10 as shown in FIG. 2). As such, the inner groove 24*b* is located adjacent to both the inner threaded portion 16*b* and the threaded mounting portion 18. Preferably, the inner grooves 24*a*, 24*b* are axially located such that the end connectors 42*a*, 42*b* of the electrical cables 48*a*, 48*b* may be substantially aligned with outer edges 50*a*, 50*b* of the inner groove 24*a*, 24*b* when the end connectors 42*a*, 42*b* are threaded onto the electrical connector 10.

Preferably, the outer groves 22*a*, 22*b* and the inner grooves 24*a*, 24*b* are formed by taking an electrical connector having uninterrupted threads on each side and removing sections of threads in any way known in the art to form the outer groves 22*a*, 22*b* and the inner grooves 24*a*, 24*b*. Alternatively, the outer grooves 22*a*, 22*b* and the inner grooves 24*a*, 24*b* may be formed in the electrical connector 10 when the electrical connector 10 is initially manufactured.

Referring to FIG. 2, preferably the inner threaded portions 16*a*, 16*b* have an axial length that is less than that of the outer threaded portions 14*a*, 14*b*. Thus, it is preferable that the outer grooves 22*a*, 22*b* and the inner grooves 24*a*, 24*b* be in close proximity. For example, the axial length of the inner threaded portions 16*a*, 16*b* may be as little as a single thread or single revolution of a thread. However, the inner threaded portions 16*a*, 16*b* may also include multiple threads or a plurality of thread revolutions.

As illustrated in FIGS. 3-6, seal members, such as o-rings 32*a*, 32*b*, may be disposed within the outer grooves 22*a*, 22*b* of the body 12. The inner diameter and axial length of the o-rings 32*a*, 32*b* and the radial diameter and axial length of the outer grooves 22*a*, 22*b* preferably are coordinated, such that the o-rings 32*a*, 32*b* preferably fit snugly within the outer grooves 22*a*, 22*b*. The radial thickness of the o-rings 32*a*, 32*b*, or the outer diameter of the o-rings 32*a*, 32*b*, is sized such that the o-rings 32*a*, 32*b* are deformed by the interior threads 44*a*, 44*b* of the end connectors 42*a*, 42*b* that are connected to the electrical connector 10. For example, the o-rings 32*a*, 32*b* may have an outer diameter of 0.360±0.010 inches, an inner diameter of 0.280±0.005 inches, and an axial thickness of 0.063±0.010 inches before the o-rings 32*a*, 32*b* are stretched to be disposed in the outer grooves 22*a*, 22*b*. Alternatively, the o-rings 32*a*, 32*b* may be sized such that the o-rings 32*a*, 32*b* extend or project beyond the outer diameter of the threads 38*a*, 38*b*, 40*a*, and 40*b*, of the threaded portions 14*a*, 14*b*, 16*a*, and 16*b* of the electrical connector 10. Thus, the o-rings 32*a*, 32*b* are able to be deformed to form a seal between the cylindrical portions 34*a*, 34*b* and the interior threads 44*a*, 44*b* of the end connectors 42*a*, 42*b* of the electrical cables 48*a*, 48*b*.

The o-rings 32*a*, 32*b* preferably have a rectangular or square cross-section but, alternatively, may have a circular cross-section or any other cross-section known in the art. Preferably, the o-rings 32*a*, 32*b* are made of rubber and, more preferably, are made of a polyurethane material. The o-rings 32*a*, 32*b*, however, may be made of any material generally used in the construction of seals, such as silicone or plastic.

Although the electrical connector 10 illustrated in FIGS. 1-6 has sides 26, 28 which are asymmetric, the connector may also have sides which are symmetric about the hexagonal flange, or any other combination of side structures. For example, where only one side of the electrical connector will be exposed to the elements, the side which is protected from the elements may be that of a conventional electrical connector, while the opposite side, which is exposed to the elements, may have a seal and deflection groove. The side structure may also differ depending on the length of the different structural features, such as the axial lengths of the threaded portions and grooves.

Figure 4:
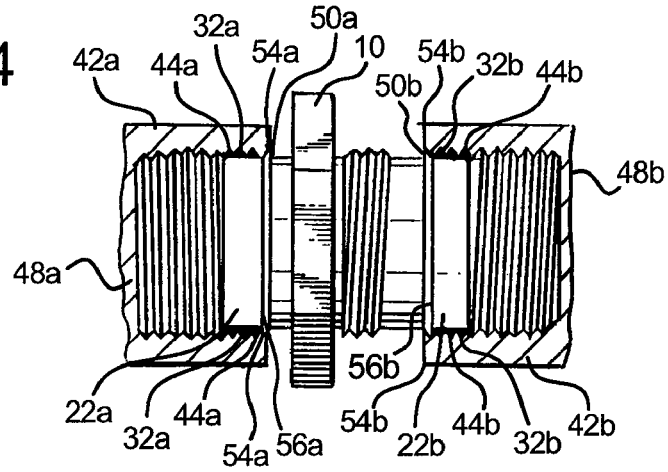
FIG. 4 is an elevational view of the electrical connector of FIG. 1, including a cross-sectional view of the o-rings mounted on the electrical connector and ends of coaxial cables attached to the electrical connector.

As illustrated in FIG. 4, in order to form an electrical connection in a manner that provides an environmentally sealed connection, the end connectors 42*a*, 42*b* of electrical cables 48*a*, 48*b* are threaded onto the electrical connector 10, with the interior threads 44*a*, 44*b* of the cables 48*a*, 48*b* threading onto the outer threaded portions 14*a*, 14*b*. As the end connectors 42*a*, 42*b* are threaded further onto the electrical connector 10, the interior threads 44*a*, 44*b* come into contact with the o-rings 32*a*, 32*b* disposed in the outer grooves 22*a*, 22*b*. Generally, the interior threads 44*a*, 44*b* cause the outer surfaces 52*a*, 52*b* of the o-rings 32*a*, 32*b* to deform around the threads 44*a*, 44*b* and expand axially in the outer grooves 22*a*, 22*b* and form a seal between the electrical connector 10 and the end connectors 42*a*, 42*b*.

The end connectors 42*a*, 42*b* are further threaded onto the electrical connector 10, until the leading edges 54*a*, 54*b* of the end connectors 42*a*, 42*b* extend beyond the inner edges 56*a*, 56*b* of the outer grooves 22*a*, 22*b*. The interior threads 44*a*, 44*b* of the end connectors 42*a*, 42*b* of the electrical cables 48*a*, 48*b* then are brought into contact with, or are threaded onto, the inner threaded portions 16*a*, 16*b* as the end connectors 42*a*, 42*b* are further threaded onto the electrical connector 10. The end connectors 42*a*, 42*b* of the cables 48*a*, 48*b* are threaded onto the electrical connector 10 until the end connectors 42*a*, 42*b* are fully threaded onto the connector 10.

Preferably, the leading edges 54*a*, 54*b* of the end connectors 42*a*, 42*b* extend at least slightly beyond the outer edges 50*a*, 50*b* of the inner grooves 24*a*, 24*b* when the end connectors 42*a*, 42*b* are fully threaded onto the electrical connector 10. Alternatively, the leading edges 54*a*, 54*b* may extend beyond the outer edges 50*a*, 50*b* at a point before the end connectors 42*a*, 42*b* are fully threaded onto the electrical connector 10. Thus, the connection of the end connectors 42*a*, 42*b* to the electrical connector 10 forms an environmental seal between the connector 10 and the end connectors 42*a*, 42*b* of the cables 48*a*, 48*b*, substantially preventing the migration of moisture and other debris into the interior of the cables 48*a*, 48*b* and into the cable/connector interface. The inner grooves 24*a*, 24*b* and the inner threaded portions 16*a*, 16*b* further aid this process by causing moisture and other debris to migrate away from the outer grooves 22*a*, 22*b* and the o-rings 32. That is, the inner grooves 24*a*, 24*b* may deflect foreign matter away from the inner grooves 22*a*, 22*b* and the o-rings 32*a*, 32*b*.

Figure 5:
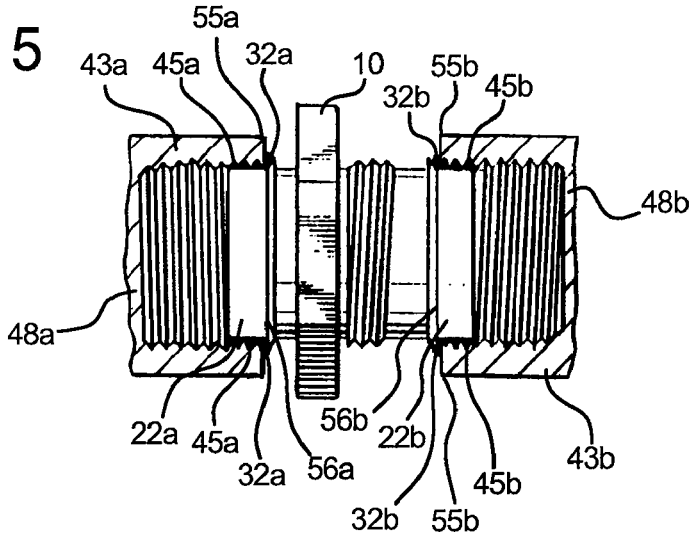
FIG. 5 is an elevational view of the electrical connector of FIG. 1, including a cross-sectional view of the o-rings mounted on the electrical connector and ends of coaxial cables attached to the electrical connector.
Figure 6:
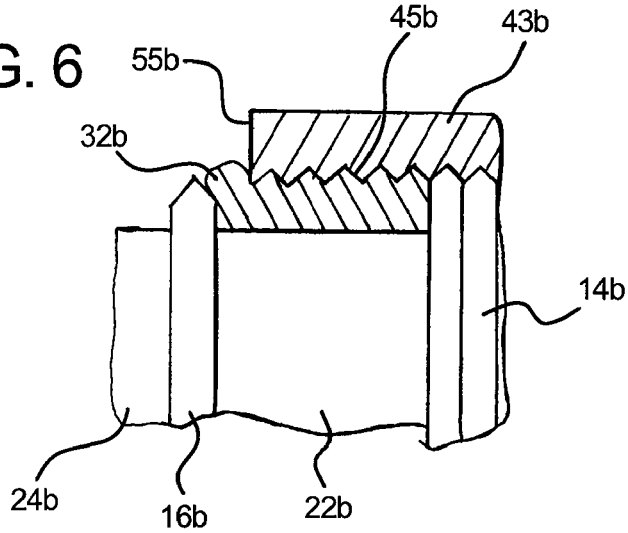
FIG. 6 is an enlarged elevational partial view of the electrical connector of FIG. 1, showing the inner thread/o-ring/end connector interface of FIG. 5.
Figure 7:
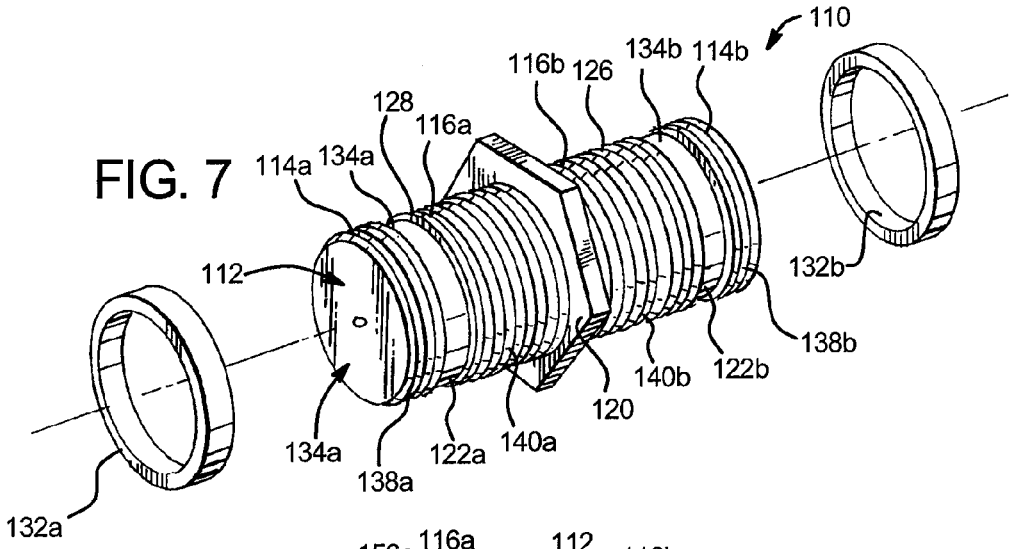
FIG. 7 is an exploded perspective view of another embodiment of an electrical connector embodying features of the present invention.
Figure 8:
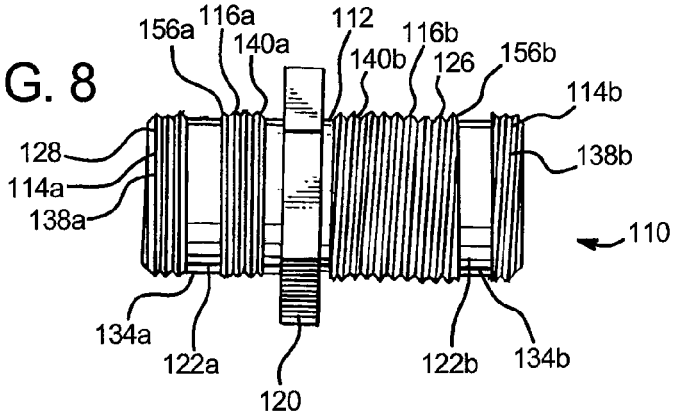
FIG. 8 is a elevational view of the electrical connector of FIG. 7 without the o-rings.

An alternative method of making a seal with the o-ring 32*a*, 32*b*, which is used with end connectors 43*a*, 43*b* which do not extend beyond the outer groove 22*a*, 22*b*, is illustrated in FIGS. 5-6. In order to form an electrical connection in such a case, the end connectors 43*a*, 43*b* of electrical cables 48*a*, 48*b* are threaded onto the electrical connector 10, with the interior threads 45*a*, 45*b* of the cables 48*a*, 48*b* threading onto the outer threaded portions 14*a*, 1413. As the end connectors 43*a*, 43*b* are threaded further onto the electrical connector 10, the interior threads 45*a*, 45*b* come into contact with the o-rings 32*a*, 32*b* disposed in the outer grooves 22*a*, 22*b*. Generally, the interior threads 45*a*, 45*b* cause the outer surfaces 52*a*, 52*b* of the o-rings 32*a*, 32*b* to deform around the threads 45*a*, 45*b* and expand axially in the outer grooves 22*a*, 22*b* and form a seal between the electrical connector 10 and the end connectors 43*a*, 43*b*. Additionally, as the end connectors 43*a*, 43*b* are threaded onto the electrical connector 10, the end connectors 43*a*, 43*b* causes the o-rings 32*a*, 32*b* to bunch up or bulge just ahead of the end connectors 43*a*, 43*b* due to the axial expansion of the o-rings 32*a*, 32*b* and the axial movement of the end connectors 43*a*, 43*b* as the end connectors 43*a*, 43*b* are threaded onto the electrical connector 10. In a preferred situation, this bulging of the o-rings 32*a*, 32*b* ensures that the o-rings 32*a*, 32*b* have expanded into and around the structure at this connection to provide an enhanced seal.

The end connectors 43*a*, 43*b* are further threaded onto the electrical connector 10, until the end connectors 43*a*, 43*b* are fully threaded onto the connector 10. Since the end connectors 43*a*, 43*b* are not long enough to extend fully over the outer grooves 22*a*, 22*b*, when the end connectors 43*a*, 43*b* are fully connected to the electrical connector 10, the leading edges 55*a*, 55*b* of the end connectors 43*a*, 43*b* fall somewhere within the outer grooves 22*a*, 22*b*, generally close to the inner edges 56*a*, 56*b* of the outer grooves 22*a*, 22*b*. However, unlike the connection shown in FIG. 4, there is a small gap between the leading edges 55*a*, 55*b* of the end connectors 43*a*, 43*b* and the inner threaded portions 16*a*, 16*b*.

Despite this small gap, and due to the bunching up or bulging of the o-rings 32*a*, 32*b* ahead of the leading edges 55*a*, 55*b* of the end connectors 43*a*, 43*b*, the o-rings 32*a*, 32*b* form slight bulges between the leading edges 55*a*, 55*b* of the end connectors 43*a*, 43*b* and the inner threaded portions 16*a*, 16*b* and form a seal between the leading edges 55*a*, 55*b* of the end connectors 43*a*, 43*b* and the inner threaded portions 16*a*, 16*b* Thus, the connection of the end connectors 43*a*, 43*b* to the electrical connector 10 forms an environmental seal between the connector 10 and the end connectors 43*a*, 43*b* of the cables 48*a*, 48*b*, substantially preventing the migration of moisture and other debris into the interior of the cables 48*a*, 48*b* and into the cable/connector interface, even when the end connectors 43*a*, 43*b* do not fully extend over the outer grooves 22*a*, 22*b*. The inner grooves 24*a*, 24*b* and the inner threaded portions 16*a*, 16*b* further aid this process by causing moisture and other debris to migrate away from the outer grooves 22*a*, 22*b* and the o-rings 32. That is, the inner grooves 24*a*, 24*b* may deflect foreign matter away from the inner grooves 22*a*, 22*b* and the o-rings 32*a*, 32*b*.

Referring to FIGS. 7-10, there is illustrated an electrical connector 110 having a body 112. The body 112 includes outer threaded portions 114*a*, 114*b* and inner threaded portions 116*a*, 116*b*, which are separated by grooves 122*a*, 122*b*, respectively. Seal members, such as o-rings 132*a*, 132*b*, are disposed in the grooves 122*a*, 122*b*. When end connectors 142*a*, 142*b* of electrical cables 148*a*, 148*b* or wires are connected to the electrical connector 110, interior threads 144*a*, 144*b* of the end connectors 142*a*, 142*b* cover and deform the seal members, which, in turn, creates a seal between the electrical connector 110 and the end connectors 142*a*, 142*b*. The grooves 122*a*, 122*b* and the seal members 132*a*, 132*b* are axially located such that the electrical connector 110 universally seals between the electrical connector 110 and the end connectors 142*a*, 142*b* of electrical cables or wires, regardless of the axial length of the end connectors 142*a*, 142*b*. Thus, the electrical connector 110 effectively seals the interface between the connector and the end connectors of electrical cables, such that moisture and other debris are deterred from migrating into the interior of the cable.

The body 112 includes a hexagonal flange 120 separating a first cylindrical portion 134*a* and a second cylindrical portion 134*b*. The two cylindrical portions 134*a*, 134*b* surround the interior structure of the electrical connector 10. The first cylindrical portion 134*a* includes one of the outer threaded portions 114*a* and one of the inner threaded portions 116*a*. The second cylindrical portion 134*b* includes the other outer threaded portion 114*b* and the other inner threaded portions 116*b*. The respective diameters of the cylindrical portion 134*a*, 134*b*, as well as the outer threaded portions 114*a*, 114*b* and the inner threaded portions 116*a*, 116*b*, are sized to allow the connection of electrical cable or wire connectors to each of the cylindrical portions 134*a*, 134*b*.

The body 112 is constructed of a conductive material, preferably brass with tin plating. The internal structure of the electrical connector is that of any conventional electrical connector known in the art and may include a conductive center surrounded by an insulating jacket.

The body 112 and the hexagonal flange 120 may be sized to compliment the size of the wires or cables which are to be attached to the electrical connector 110. For example, if a conventionally sized coaxial cable, such as that used to distribute cable television or cable internet signals, is to be attached to the connector 110, the body 112 may have an overall axial length of approximately 1.025±0.010 inches, and the cylindrical portions 134*a*, 134*b* may have an outer thread diameter of approximately 0.365±0.010 inches, while the hexagonal flange 20 may have a thickness of approximately 0.145±0.010 inches, a diameter of approximately 0.432±0.010 inches between opposing flats of the hexagon, and a diameter of approximately 0.490±0.010 inches between opposing corners of the hexagon.

More specifically, the cylindrical portions 134*a*, 134*b* include the outer threaded portion 114*a*, 114*b* and the inner threaded portions 116*a*, 116*b*, respectively, which are sized to receive end connectors 142*a*, 142*b* of electrical cables 148*a*, 148*b*. For example, the outer threaded portions 114*a*, 114*b* and the inner threaded portions 116*a*, 116*b* may be of 3/8-32 UNEF-2A threading, although alternative threading sizes may be used depending on other sizes of electrical cable and wires and the corresponding end connectors for such.

The outer threaded portions 114*a*, 114*b* include threads 138*a*, 138*b*, respectively, for receiving the interior threads 144*a*, 144*b* of the end connectors 142*a*, 142*b* of electrical cables or wires. Likewise, the inner threaded portions 116*a*, 116*b* include threads 140*a*, 140*b* for receiving the interior threads 144*a*, 144*b* of the end connectors 142*a*, 142*b*. The threads 138*a*, 138*b* of the outer threaded portions 114*a*, 114*b* and the threads 140*a*, 140*b* of the inner threaded portions 116*a*, 116*b* are circumferentially and axially aligned, so as to be continuous, such that interior threads 144*a*, 144*b* of end connectors 142*a*, 142*b* of electrical cables 148*a*, 148*b* may be fully attached to the outer threaded portions 114*a*, 114*b* and the inner threaded portions 116*a*, 116*b*. That is, if the threads 138*a*, 138*b* of the outer threaded portions 114*a*, 114*b* and the threads 140*a*, 140*b* of the inner threaded portions 116*a*, 116*b* are offset around the circumference of the cylindrical portions 134*a*, 134*b*, the end connectors 142*a*, 142*b* of the electrical cables 148*a*, 148*b* are deterred and, in some cases, prevented from fully threading into the electrical connector 110 because the interior threads 144*a*, 144*b* cannot thread smoothly, if it all, onto the offset threads of the inner threaded portions 116*a*, 116*b* after threading onto the outer threaded portions 114*a*, 114*b*. In any event, when the threads of the outer and inner threaded portions 114*a*, 114*b*, 116*a*, and 116*b* are offset, the threading of both the electrical connector 110 and the end connectors 142*a*, 142*b* is likely to be damaged by forcing the end connectors 142*a*, 142*b* onto the inner threaded portions 116*a*, 116*b* of the electrical connector 110.

The threads 140*a*, 140*b* of the inner threaded portions 116*a*, 116*b* preferably also enable the electrical connector 110 to be attached to a supporting structure. For example, if it is desirable to ground the splice between two wire or cables, the electrical connector 110 may be connected to a grounding structure, such as a grounding connector, by extending the cylindrical portion 134*b* of the electrical connector 10 through an aperture in the grounding structure with the hexagonal flange 120 on one side of the aperture and threading a nut, or other similar component, onto the opposite inner threaded portion 116*b* such that the nut can be tightened flush against the opposite side of the aperture. The threads 140*b* of the inner threaded portion 116*b* may extend into close proximity to, or adjacent to, the hexagonal flange 120 on one side 126 of the connector 10 in order to receive a nut, or similar component, when the electrical connector 110 is attached to a supporting or grounding structure. However, the inner threaded portions 116*a*, 116*b* need not be designed to receive a nut if such an ability to connect to a supporting or grounding structure is not necessary.

The first cylindrical portion 134*a* preferably defines a first groove 122*a* and the second cylindrical portion 134*b* defines a second groove 122*b*. The grooves 122*a*, 122*b* preferably have a diameter which is less than that of the threaded portions 114*a*, 114*b*, 116*a*, and 116*b* of the electrical connector 110. For example, the grooves 122*a*, 122*b* may have a diameter of approximately 0.30±0.010 inches. Alternatively, the cylindrical portions 134*a*, 134*b* may define unthreaded portions of the body 112 having a diameter less than the threaded portions 114*a*, 114*b*, 116*a*, and 116*b* of the electrical connector 110. The grooves 122*a*, 122*b* may have a variety of axial lengths. It is preferred that the axial length of the grooves 122*a*, 122*b* corresponds with the axial length of the seal members. For example, where the electrical connector is to be used with a conventional sized coaxial cable and end connector, the axial length of the grooves 122*a*, 122*b* is preferably approximately 0.075±0.010 inches. The grooves 122*a*, 122*b* preferably have the same axial length such that seal members of a single size may be disposed in the grooves 122*a*, 122*b*. The grooves 122*a*, 122*b*, however, may have different axial lengths if such a difference is desirable.

The groove 122*a* is located between the outer threaded portion 114*a* and the inner threaded portion 116*a* on one side 128 of the electrical connector 110. Similarly, the groove 122*b* is located between the outer threaded portion 114*b* and the inner threaded portion 116*b* on an opposite side 126 of the electrical connector 110.

Preferably, the grooves 122*a*, 122*b* are axially located such that the end connectors 142*a*, 142*b* of the electrical cables 148*a*, 148*b* may extend over and beyond the grooves 122*a*, 122*b*, respectively, and be threaded onto the inner threaded portions 116*a*, 116*b* when threaded onto the electrical connector 110. The grooves 122*a*, 122*b* are axially located such that the variation in axial length of end connectors of the electrical cables is taken into account. That is, the location of the grooves 122*a*, 122*b* is such that end connectors of a range of different axial lengths extend over and beyond the grooves 122*a*, 122*b* and thread onto the inner threaded portions 116*a*, 116*b*. For example, if the electrical connector is to be used with a conventional sized coaxial cable end connectors, the outer threaded portions 114*a*, 114*b* may have an axial length of approximately 0.125±0.010 inches, and the grooves 122*a*, 122*b* may have an axial length of approximately 0.075±0.010 inches.

The grooves 122*a*, 122*b* preferably are formed by taking an electrical connector having uninterrupted threads on each side and removing a section of threads in any way known in the art in order to form the groves 122*a*, 122*b*. Alternatively, the grooves 122*a*, 122*b* may be formed in the electrical connector 110 when the electrical connector 110 is initially manufactured.

Preferably, the inner threaded portion 116*a* has an axial length that is generally the same as the axial length of the outer threaded portion 114*a*, and the inner threaded portion 116*b* has an axial length which is greater than the axial length of the outer threaded portion 114*b*. Alternatively, the inner threaded portions 116*a*, 116*b* may have an axial length that is smaller than that of the outer threaded portions 114*a*, 144*b*. For example, the axial length of the inner threaded portions 116*a*, 116*b* may be as little as a single thread or single revolution of a thread. However, the axial length of the inner threaded portions 116*a*, 116*b* must have sufficient threading or revolutions of threads to allow the end connectors 142*a*, 142*b* of the cable 148*a*, 148*b* to be effectively threaded onto the inner threaded portions 116*a*, 116*b*.

Figure 9:
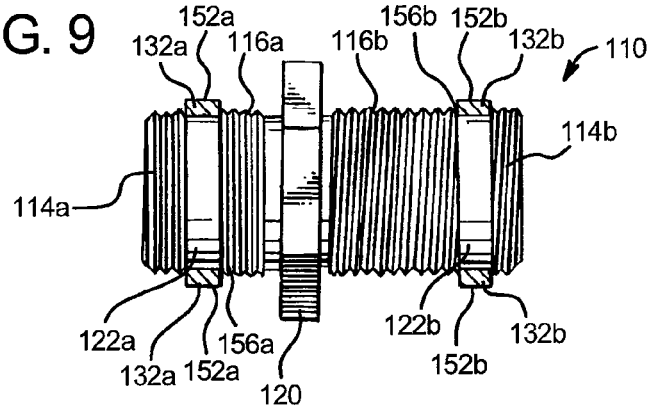
FIG. 9 is an elevational view of the electrical connector of FIG. 7, including a cross-sectional view of the o-rings mounted on the electrical connector.
Figure 10:
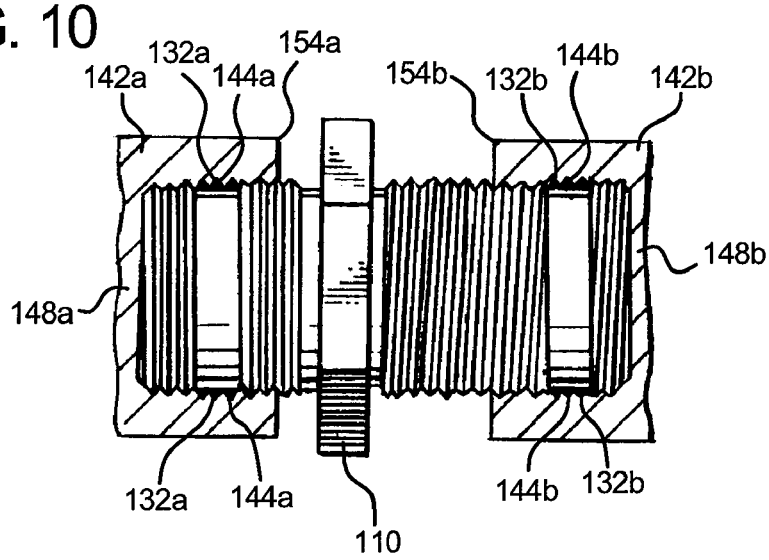
FIG. 10 is an elevational view of the electrical connector of FIG. 7, including a cross-sectional view of the o-rings mounted on the electrical connector and ends of coaxial cables attached to the electrical connector.

As illustrated in FIGS. 9 and 10, seal members, such as o-rings 132*a*, 132*b*, are disposed within the grooves 122*a*, 122*b* of the body 112. The inner diameter and axial length of the o-rings 132*a*, 132*b* and the radial depth and axial length of the grooves 122*a*, 122*b* preferably are sized such that the o-rings 132*a*, 132*b* fit snugly within the grooves 122*a*, 122*b*. The radial thickness of the o-rings 132*a*, 132*b*, or the outer diameter of the o-rings 132*a*, 132*b*, is sized such that the o-rings 132*a*, 132*b* are deformed by the interior threads 144*a*, 144*b* of the end connectors 142*a*, 142*b* that are connected to the electrical connector 110. For example, the o-rings 132*a*, 132*b* may have an outer diameter of 0.360±0.010 inches, an inner diameter of 0.280±0.005 inches, and an axial thickness of 0.063±0.010 inches before the o-rings 132*a*, 132*b* are stretched to be disposed in the grooves 122*a*, 122*b*. Alternatively, the o-rings 132*a*, 132*b* may be sized such that the o-rings 132*a*, 132*b* extend or project beyond the outer diameter of the threads 138*a*, 138*b*, 140*a*, and 140*b*, of the threaded portions 114*a*, 114*b*, 116*a*, and 116*b* of the electrical connector 110. Thus, the o-rings 132*a*, 132*b* are able to be deformed to form an effective seal between the cylindrical portions 134*a*, 134*b* and the interior threads 144*a*, 144*b* of the end connectors 142*a*, 142*b* of the electrical cables 148*a*, 148*b*.

The o-rings 132*a*, 132*b* preferably have a rectangular or square cross-section, but the o-rings 132*a*, 132*b* alternatively may have a circular cross-section or any other cross-section known in the art. Preferably, the o-rings 132*a*, 132*b* are made of rubber and, more preferably, are made of a polyurethane material. The o-rings 132*a*, 132*b*, however, maybe made of any material generally used in the construction of seals, such as silicone or plastics.

Although the connector 110 illustrated herein has sides 126, 128 which are asymmetric, the connector 110 also may have sides which are symmetric about the hexagonal flange or any other combination of side structures. For example, where only one side of the electrical connector will be exposed to the elements, the side which is protected from the elements may be that of a conventional electrical connector, while the opposite side, which is exposed to the elements, may be that of the electrical connector 110 illustrated herein. The side structures may also differ based on the axial length of the different features, such as the axial length of the threaded portions and grooves.

As illustrated in FIG. 10, in order to form an electrical connection in a manner that provides an environmentally sealed connection, the end connectors 142*a*, 142*b* of the electrical cables 148*a*, 148*b* are threaded onto the electrical connector 110, with the interior threads 144*a*, 144*b* of the end connector 142*a*, 142*b* threading onto the outer threaded portions 114*a*, 114*b*. As the end connectors 142*a*, 142*b* are threaded further onto the electrical connector 110, the interior threads 144*a*, 144*b* come into contact with the o-rings 132*a*, 132*b*. Generally, the interior threads 144*a*, 144*b* cause the outer surfaces 152*a*, 152*b* of the o-rings 132*a*, 132*b* to deform around the threads 144*a*, 144*b* and the o-rings 132*a*, 132*b* to expand in the grooves 122*a*, 122*b*. This deformation and expansion forms an effective seal between the electrical connector 110 and the end connectors 142*a*, 142*b*.

The end connectors 142*a*, 142*b* are further threaded onto the inner threaded portions 116*a*, 116*b* of the electrical connector 110. The end connectors 142*a*, 142*b* are further threaded onto the electrical connector 110 until the end connectors 142*a*, 142*b* have been fully threaded onto the connector 110, at which point leading edges 154*a*, 154*b* of the end connectors 142*a*, 142*b* preferably extend beyond the inner edges 156*a*, 156*b* of the grooves 122*a*, 122*b*, such that the leading edges 154*a*, 154*b* fall generally within the inner threaded portions 116*a*, 116*b* and the grooves 122*a*, 122*b* and the o-rings 132*a*, 132*b* are axially displaced away from the leading edges 154*a*, 154*b*.

Preferably, the grooves 122*a*, 122*b* and the o-rings 132*a*, 132*b* are located in the interior of the end connectors 142*a*, 142*b* of the electrical cables 148*a*, 148*b* when the end connectors 142*a*, 142*b* are fully threaded onto the electrical connector 110, such that the interior threads 144*a*, 144*b* of the end connectors 142*a*, 142*b* are threaded onto both the outer threaded portions 114*a*, 114*b* and the inner threaded portions 116*a*, 116*b*. Thus, the connection of the end connectors 142*a*, 142*b* to the electrical connector 110 forms an environmental seal between the connector 110 and the end connectors 142*a*, 142*b* of the cables 148*a*, 148*b*, preventing and/or substantially deterring the migration of moisture and other debris into the interior of the cables 148*a*, 148*b* and into the cable/connector interface. The threads 140*a*, 140*b* of the inner threaded portions 116*a*, 116*b* further aid this process by causing moisture and other debris to migrate away from the grooves 122*a*, 122*b* and the o-rings 132*a*, 132*b*, much like the inner grooves 24*a*, 24*b* and the inner threaded portion 16*a*, 16*b* of the electrical connector 10 discussed above. That is, the threads 140*a*, 140*b* of the inner threaded portions 116*a*, 116*b* may deflect foreign matter away from the grooves 122*a*, 122*b* and the o-rings 132*a*, 132*b*.

While the electrical connectors illustrated in FIGS. 1-10 are shown to be of the type used in the splicing of two electrical cables, other types of electrical connectors and components having a threaded connector may also be designed to include objects of the present invention. Such connectors and components may include, but are not limited to, "F" connectors and "F" jacks for coaxial cables, in-line splicing hardware, digital splitters, splitters, ground blocks, signal amplifiers, directional couplers, angled adapters, terminators, wall plates, reducer/adapters, couplers, combiners, cable surge protectors, satellite/TV antenna diplexers, and converters.

Figure 11:
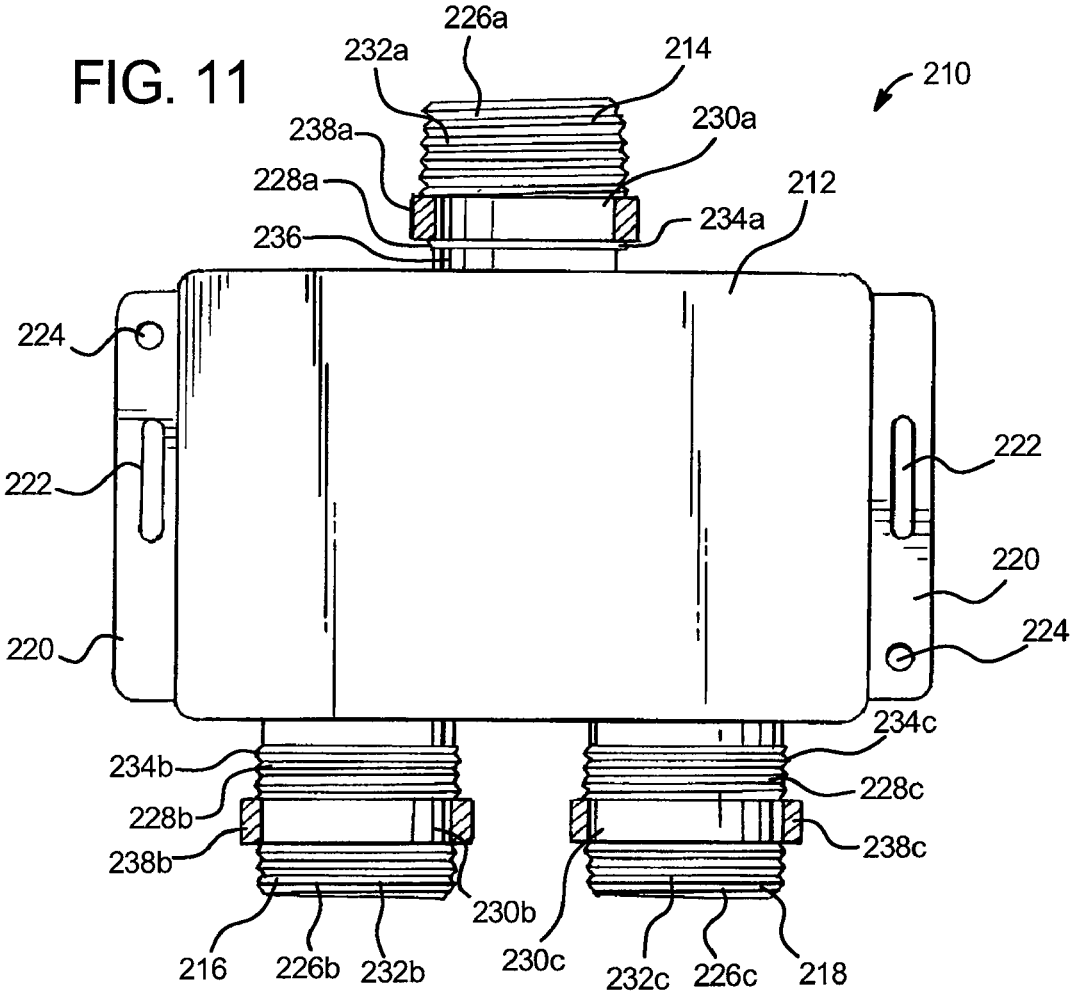
FIG. 11 is a plan view of another embodiment of an electrical connector embodying features of the present invention.

For example, FIG. 11 illustrates a splitter 210 having a body 212. The body 212 surrounds any internal structure for splitting cable or electrical signals. The body 212 includes a first cylindrical portion 214, a second cylindrical portion 216, and a third cylindrical portion 218. Preferably, the first cylindrical portion 214 is located opposite the second cylindrical portion 216 and the third cylindrical portion 218. However, the cylindrical portions 214, 216, and 218 may alternatively have any configuration known in the art. For example, the second cylindrical portion 216 may be located opposite the third cylindrical portion 218, and the second and third cylindrical portions 216, 218 may be located along an axis perpendicular to that of the first cylindrical portion 214.

Preferably, the first cylindrical portion 214 may act as an input for the electrical signal, and the second cylindrical portion 216 and the third cylindrical portion 218 may act as the two outputs for the electrical signal. However, any of the three cylindrical portions 214, 216, and 218 may act as the input and the remaining two cylindrical portions may act as the outputs.

The body 212 of the splitter 210 may optionally include attachment portions or flanges 220. The attachment portions 220 may include attachment apertures 222 for receiving a fastener to attach the splitter 210 to a preexisting structure, such as a wall, ceiling, floor, or other suitable structure. The attachment portions 220 may also include apertures 224 for receiving fasteners for securing a grounding wire to the splitter 210. Alternatively, the body 212 may include a structure for securing a grounding wire to the splitter 210. While the attachment portions 220 may preferably be included in most cases, the attachment portions 220 may also be omitted from the splitter 210. The body 212 is constructed of a conductive material, preferably brass with tin plating.

The first cylindrical portion 214 includes an outer threaded portion 226*a* and an inner threaded portion 228*a*, which are separated by a groove 230*a*. The groove 230*a* preferably has a diameter which is less than that of the threaded portions 226*a* and 228*a*. The groove 230*a* may also be defined by an unthreaded portion of the first cylindrical portion 214. Preferably, the groove 230*a* is axially located such that the leading edge of the end connector of the electrical cable extends at least into the groove 230*a* and in some cases beyond the groove 230*a* when the end connector is threaded onto the first cylindrical portion 214. More specifically, for example, the groove 230*a* may be axially located such that when the variation in the depth of different end connectors is taken into account, the location of the groove 230*a* is such that a variety of different end connectors extend at least partially over, or over and beyond, the groove 230*a*. The groove 230*a* may be formed by taking a splitter having uninterrupted threads on the first cylindrical portion 214 and removing a section of the threads in any way known in the art to form the groove 230*a*.

Preferably, the inner threaded portion 228*a* of the first cylindrical portion 214 has an axial length that is less than that of the outer threaded portion 226*a*. For example, the axial length of the inner threaded portion 228*a* may be as short as a single thread or single revolution of a thread. However, the inner threaded portion 228*a* may also include multiple threads or a plurality of thread revolutions.

Optionally, the first cylindrical portion 214 may include an inner groove 236 located between the body 212 of the splitter 210 and the inner threaded portion 228*a* of the first cylindrical portion 214. If the inner groove 236 is used in connection with any of the cylindrical portions, such as the first cylindrical portion 214, the inner groove 236 should have an axial length that effectively deflects moisture and other foreign debris away from the sealed connection. Optionally, the first cylindrical portion 214 may include a threaded mounting portion adjacent the body 212 of the splitter 210 for attaching the splitter to a structure, such as a grounding connector.

The second cylindrical portion 216 includes an outer threaded portion 226*b* and an inner threaded portion 228*b*, which are separated by a groove 230*b*. Likewise, the third cylindrical portion 218 includes an outer threaded portion 226*c* and an inner threaded portion 228*c*, which are separated by a groove 230*c*. The grooves 230*b*, 230*c* preferably have diameters which are less than that of the threaded portions 226*b*, 226*c*, 228*b*, and 228*c*. The grooves 230*b*, 230*c* may also be defined by unthreaded portions of the second cylindrical portion 216 and third cylindrical portion 218, respectively. Preferably, the grooves 230*b*, 230*c* are axially located such that the leading edges of the end connectors of the electrical cables extend at least over the grooves 230*b*, 230*c* and, in some instances, beyond the grooves 230*b*, 230*c* and thread onto the inner threaded portions 228*b* and 228*c* when the end connectors are threaded onto the second cylindrical portion 216 and third cylindrical portion 218, respectively. More specifically, for example, the grooves 230*b*, 230*c* are axially located such that when the variation in the depth of the end connectors is taken into account, the location of the grooves 230*b*, 230*c* are such that a variety of different end connectors extend at least over, or over and beyond, the grooves 230*b*, 230*c*. The grooves 230*b*, 230*c* may be formed by taking a splitter having uninterrupted threads on the second and third cylindrical portions 216 and 218 and removing a section of the threads in any way known in the art to form the grooves 230*b*, 230*c*.

Preferably, the inner threaded portions 228*b*, 228*c* of the cylindrical portions 216, 218 have axial lengths that are generally the same as the axial length of the outer threaded portions 226*b*, 226*c*. Alternatively, the axial length of the inner threaded portions 228*b*, 228*c* may be smaller than that of the outer threaded portions 226*b*, 226*c*. For example, the axial length of the inner threaded portions 228*b*, 228*c* may be as little as a single thread or single revolution of a thread. However, the axial length of the inner threaded portions 228*b*, 228*c* should have sufficient threading or revolutions of threads to allow the end connectors of electrical cables to be effectively threaded onto the inner threaded portions 228*b*, 228*c* if desired.

The respective diameters of the cylindrical portions 214, 216, and 218, as well as the outer threaded portions 226*a*, 226*b*, and 226*c* and the inner threaded portions 228*a*, 228*b*, and 228*c*, are sized to allow the connection of electrical cable or wire connectors to each of the cylindrical portions 214, 216, and 218 by threading the connector ends onto the cylindrical portions 214, 216, and 218.

The outer threaded portions 226*a*, 226*b*, and 226*c* include threads 232*a*, 232*b*, and 232*c* for mating with the interior threads of end connectors of electrical cables or wires. Likewise, the inner threaded portions 228*a*, 228*b*, and 228*c* include threads 234*a*, 234*b*, and 234*c* for mating with the interior threads of end connectors. The threads 232*a*, 232*b*, and 232*c* of the outer threaded portions 226*a*, 226*b*, and 226*c* and the threads 234*a*, 234*b*, and 234*c* of the inner threaded portions 228*a*, 228*b*, and 228*c* are circumferentially and axially aligned, so as to be continuous, such that the interior threads of the end connectors of the electrical cables may be fully attached to the outer threaded portions 226*a*, 226*b*, and 226*c* and the inner threaded portions 228*a*, 228*b*, and 228*c* without damaging the threads. That is, the threads of the end connector and/or the splitter may become damaged when the threads of the outer and inner threaded portions 226*a*, 226*b*, 226*c*, 228*a*, 228*b*, and 228*c* are offset, effecting the seal and securement of the cables and/or wire to the splitter.

Seal members, such as o-rings 238*a*, 238*b*, and 238*c*, are disposed in the grooves 230*a*, 230*b*, and 230*c*. The inner diameter and axial length of the o-rings 238*a*, 238*b*, and 238*c* and the radial diameter and axial length of the grooves 230*a*, 230*b*, and 230*c* preferably are coordinated, such that the o-rings 238*a*, 238*b*, and 238*c* fit snugly within the grooves 230*a*, 230*b*, and 230*c*. The radial thickness of the o-rings 238*a*, 238*b*, and 238*c* or the outer diameter of the o-rings 238*a*, 238*b*, and 238*c* is sized such that the o-rings 238*a*, 238*b*, and 238*c* are deformed by the interior threads of the end connectors that are connected to the splitter 210. Thus, the o-rings 238*a*, 238*b*, and 238*c* are able to be deformed to form a seal between the cylindrical portions 214, 216, and 218 and the interior threads of the end connectors of the electrical cables.

The o-rings 238*a*, 238*b*, and 238*c* preferably have a rectangular or square cross-section but, alternatively, may have a circular cross-section or any other cross-section. Preferably, the o-rings 238*a*, 238*b*, and 238*c* are made of rubber and, more preferably, are made of a polyurethane material. The o-rings 238*a*, 238*b*, and 238*c*, however, may be made of any material generally known and used in the construction of seals, such as silicone or plastic.

Although the cylindrical portions 214, 216, and 218 of the splitter 210 illustrated in FIG. 11 are asymmetric with respect to the body 212 of the splitter 210, with the structure of the first cylindrical portion 214 being different than that of the second and third cylindrical portions 216 and 218, the splitter 210 may also have cylindrical portions which each have different structures from each other, each have the same structure, or any other combination thereof. For example, where only one cylindrical portion of the splitter will be exposed to moisture and foreign debris, the cylindrical portion(s) protected from the moisture and foreign debris may be that of a conventional electrical connector, while the cylindrical portions(s) on the opposite side, which is exposed to the moisture and foreign debris, may have a seal and deflection groove. The cylindrical portions may also differ depending on the length of the different structural features, such as the axial lengths of the threaded portions and grooves and the corresponding connectors on the ends of cables and wires.

In order to form an environmental seal, the end connectors of the electrical cables are threaded onto the cylindrical portions 214, 216, and 218 of the splitter 210, with the interior threads of the end connectors threading onto the outer threaded portions 226*a*, 226*b*, and 226*c*. As the end connectors are threaded further onto the splitter 210, the interior threads come into contact with the o-rings 238*a*, 238, and 238*c* disposed in the grooves 230*a*, 230*b*, and 230*c*. The interior threads cause the outer surfaces of the o-rings 230*a*, 230*b*, and 230*c* to deform around the threads and expand axially in the grooves 230*a*, 230*b*, and 230*c* and form a seal between the splitter 210 and the end connectors.

The end connectors are further threaded onto the cylindrical portions 214, 216, and 218 until the end connectors are fully threaded onto the cylindrical portions 214, 216, and 218. In the case of the first cylindrical portion 214, the leading edge of the end connector preferably extends slightly beyond the outer edge of the inner groove 236. In the case of the second and third cylindrical portions 216 and 218, the end connector preferably partially threads onto the inner threaded portions 228*b* and 228*c*. Thus, the connection of the end connectors to the splitter 210 forms an environmental seal between the splitter 210 and the end connectors of electrical cables, substantially preventing or deterring the migration of moisture and other debris into the interior of the cables and into the cable/splitter interface. The inner groove 236, if included, and the threads 234*a*, 234*b*, and 234*c* further aid in this process by deflecting moisture and other foreign debris away from the grooves 230*a*, 230*b*, and 230*c* and the o-rings 238*a*, 238*b*, and 238*c*. Alternatively, the end connectors could be sized to cause the sealing bulge discussed above with respect to FIGS. 5 and 6.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An electrical connection comprising:

a first threaded portion for attachment to a cable connector;

a second threaded portion for attachment to the cable connector;

a groove located between the first threaded portion and the second threaded portion; and an o-ring disposed in the groove, wherein the o-ring has a cross-section sized such that the o-ring seals an interface at the electrical connection when the cable connector threadably engages both the first threaded portion and the second threaded portion.

2. The electrical connection of claim 1, wherein the o-ring has a cross-section sized such that the o-ring deforms to substantially seal an interface at the electrical connection with the cable connector.

3. The electrical connection of claim 1, wherein the o-ring has a circular cross-section.

4. The electrical connection of claim 3, wherein the groove has a width and the circular cross-section of the o-ring has a diameter substantially the same as the width of the groove.

5. The electrical connection of claim 1, wherein the o-ring has a rectangular cross-section.

6. The electrical connection of claim 5, wherein the groove has a width and the rectangular cross-section of the o-ring has at least one dimension substantially the same as the width of the groove.

7. The electrical connection of claim 1, wherein the electrical connection includes a hexagonal flange separating a first cylindrical portion from a second cylindrical portion.

8. The electrical connection of claim 1, wherein the first threaded portion and the second threaded portion each include at least one thread revolution.

9. The electrical connection of claim 1, wherein the first threaded portion includes at least a plurality of thread revolutions.

10. The electrical connection of claim 1, wherein the second threaded portion includes at least a plurality of thread revolutions.

11. The electrical connection of claim 1, wherein the groove is a first groove, and further comprising a second groove to deflect foreign matter away from the first groove and the o-ring.

12. The electrical connection of claim 11, wherein the second groove is located adjacent to one of the first threaded portion and the second threaded portion.

13. The electrical connection of claim 11 further comprising a third threaded portion, wherein the second groove is located between the second threaded portion and the third threaded portion.

14. The electrical connection of claim 1, wherein the o-ring is made of polyurethane.

15. The electrical connection of claim 1, wherein the o-ring is made of rubber.

16. The electrical connection of claim 1, wherein the o-ring is made of silicone.

17. The electrical connection of claim 1, wherein the o-ring is made of plastic.

18. The electrical connection of claim 1, wherein the electrical connection is an in-line splice.

19. The electrical connection of claim 1, wherein the electrical connection is a splitter.

20. The electrical connection of claim 1, wherein the electrical connection is a ground block.

21. The electrical connection of claim 1, wherein the electrical connection is a signal amplifier.

22. The electrical connection of claim 1, wherein the electrical connection is a coupler.

23. An electrical connection comprising:

a first threaded portion for attachment to a cable connector;

a second threaded portion for attachment to the cable connector;

a threaded mounting portion for attachment of the electrical connection to a supporting structure;

a groove located between the first threaded portion and the second threaded portion; and an o-ring disposed in the groove, wherein the o-ring has a cross-section sized such that the o-ring seals an interface at the electrical connection and prevents debris, moisture, and other environmental conditions from affecting the cable connector when the cable connector threadably engages the first threaded portion, the o-ring, and the second threaded portion.

* * * * *